US007629898B2

(12) United States Patent
Kirkpatrick

(10) Patent No.: US 7,629,898 B2
(45) Date of Patent: Dec. 8, 2009

(54) METHODS, SYSTEMS AND COMPUTER PROGRAM PRODUCTS FOR PROVIDING AN EMERGENCY VEHICLE ALERT

(75) Inventor: Mark Kirkpatrick, Conyers, GA (US)

(73) Assignee: AT&T Intellectual Property I, L.P., Reno, NV (US)

( * ) Notice: Subject to any disclaimer, the term of this patent is extended or adjusted under 35 U.S.C. 154(b) by 441 days.

(21) Appl. No.: 11/557,818

(22) Filed: Nov. 8, 2006

(65) Prior Publication Data

US 2008/0106435 A1 May 8, 2008

(51) Int. Cl.
*G08G 1/00* (2006.01)

(52) U.S. Cl. ..... 340/902; 340/691.6; 340/692

(58) Field of Classification Search ..... 340/902, 340/692, 691.6

See application file for complete search history.

(56) References Cited

U.S. PATENT DOCUMENTS 3,876,940 A * 4/1975 Wickord et al. ..... 340/902
5,572,201 A * 11/1996 Graham et al. ..... 340/902
6,895,332 B2 * 5/2005 King et al. ..... 340/902
6,940,422 B1 9/2005 Bachelder et al.
6,987,464 B2 1/2006 Pearson
2004/0246144 A1 * 12/2004 Siegel et al. ..... 340/902
2007/0132608 A1 * 6/2007 Votaw et al. ..... 340/903
2007/0132609 A1 * 6/2007 Stackelhouse ..... 340/904
2007/0159354 A1 * 7/2007 Rosenberg ..... 340/902
2008/0074286 A1 * 3/2008 Gill et al. ..... 340/902

* cited by examiner

*Primary Examiner*—Thomas J Mullen
(74) *Attorney, Agent, or Firm*—Myers Bigel Sibley & Sajovec, P.A.

(57) ABSTRACT

A method for providing an emergency vehicle alert to an occupant of a second vehicle includes: receiving an alert signal at a receiver device on the second vehicle from the emergency vehicle; and, responsive to the received alert signal, automatically warning the occupant of the second vehicle that the emergency vehicle may be approaching and/or is in a vicinity of the second vehicle.

20 Claims, 5 Drawing Sheets

METHODS, SYSTEMS AND COMPUTER PROGRAM PRODUCTS FOR PROVIDING AN EMERGENCY VEHICLE ALERT

FIELD OF THE INVENTION

The present invention relates to emergency vehicles and, more particularly, to emergency vehicle alerts.

BACKGROUND OF THE INVENTION

Emergency vehicles commonly employ a siren or the like to warn drivers of other vehicles of their approach. Such other drivers typically respond to the siren sound by moving or stopping as appropriate to clear a path for or avoid crossing the path of the emergency vehicle. However, many drivers are unable to hear the siren of an approaching emergency vehicle over loud music or other distractions in or about their vehicle. As a result, these drivers may unnecessarily delay emergency vehicles in reaching victims and/or may cause accidents with the emergency vehicles or other vehicles.

SUMMARY OF THE INVENTION

According to embodiments of the present invention, a method for providing an emergency vehicle alert to an occupant of a second vehicle includes: receiving an alert signal at a receiver device on the second vehicle from the emergency vehicle; and, responsive to the received alert signal, automatically warning the occupant of the second vehicle that the emergency vehicle may be approaching and/or is in a vicinity of the second vehicle.

According to further embodiments of the present invention, a method for providing an emergency vehicle alert to an occupant of a second vehicle includes: emitting an alert signal from the emergency vehicle to a receiver device on the second vehicle. The receiver device is responsive to the received alert signal to automatically warn the occupant of the second vehicle that the emergency vehicle may be approaching and/or is in a vicinity of the second vehicle.

According to embodiments of the present invention, an alert system for providing an emergency vehicle alert to an occupant of a second vehicle includes a receiver device on the second vehicle. The receiver device is configured to: receive an alert signal from the emergency vehicle; and, responsive to the received alert signal, automatically warn the occupant of the second vehicle that the emergency vehicle may be approaching and/or is in a vicinity of the second vehicle.

According to embodiments of the present invention, a computer program product for providing an emergency vehicle alert to an occupant of a second vehicle is provided. The computer program product includes a computer readable storage medium including computer readable program code embodied therein. The computer readable program code includes: computer readable program code configured to receive an alert signal at a receiver device on the second vehicle from the emergency vehicle; and computer readable program code configured to automatically warn the occupant of the second vehicle that the emergency vehicle may be approaching and/or is in a vicinity of the second vehicle in response to the received alert signal.

Other methods, systems, devices, and/or computer program products according to other embodiments of the invention will become apparent to one with skill in the art upon review of the following drawings and detailed description. It is intended that all such additional methods, systems, devices, and/or computer program products be included within this description, be within the scope of the present invention, and be protected by the accompanying claims.

DETAILED DESCRIPTION OF EMBODIMENTS OF THE INVENTION

Figure 1:
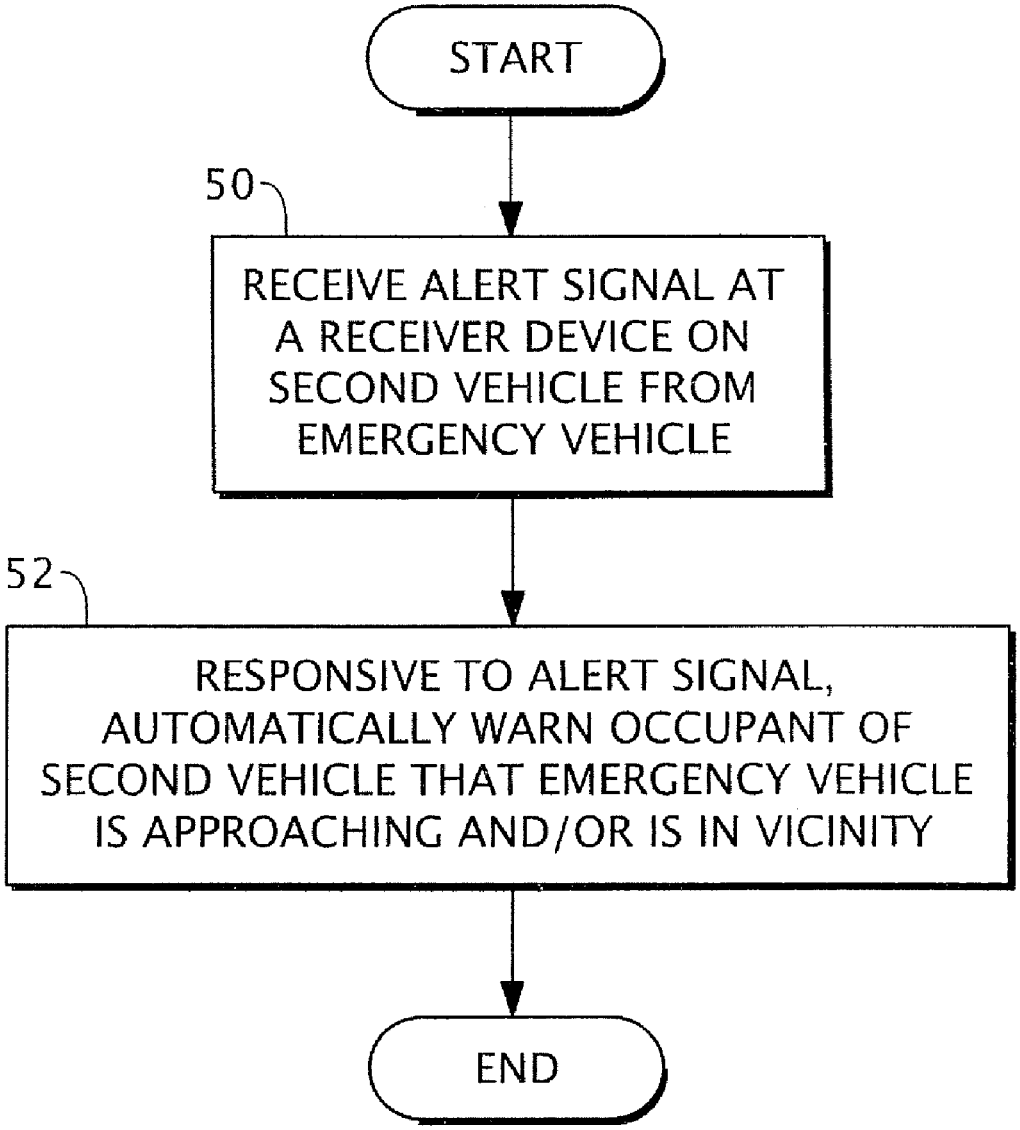
FIG. 1 is schematic flowchart illustrating methods according to some embodiments of the present invention.

Specific exemplary embodiments of the invention will now be described with reference to the accompanying drawings. This invention may, however, be embodied in many different forms and should not be construed as limited to the embodiments set forth therein. Rather, these embodiments are provided so that this disclosure will be thorough and complete, and will fully convey the scope of the invention to those skilled in the art. The terminology used in the detailed description of the particular exemplary embodiments illustrated in the accompanying drawings is not intended to be limiting of the invention. In the drawings, like numbers refer to like elements.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will be understood that, although the terms first, second, etc. may be used herein to describe various elements, these elements should not be limited by these terms. These terms are only used to distinguish one element from another.

The present invention is described hereinafter with reference to flowchart and/or block diagram illustrations of systems, methods, and computer program products in accordance with some embodiments of the invention. These flowchart and/or block diagrams further illustrate exemplary operations of the system and device architectures. It will be understood that each block of the flowchart and/or block diagram illustrations, and combinations of blocks in the flowchart and/or block diagram illustrations, may be implemented by computer program instructions and/or hardware operations. These computer program instructions may be provided to a processor of a general purpose computer, a special purpose computer, or other programmable data processing apparatus to produce a machine, such that the instructions, which execute via the processor of the computer or other programmable data processing apparatus, create means for implementing the functions specified in the flowchart and/or block diagram block or blocks.

These computer program instructions may also be stored in a computer usable or computer-readable memory that may direct a computer or other programmable data processing apparatus to function in a particular manner, such that the instructions stored in the computer usable or computer-readable memory produce an article of manufacture including instructions that implement the function specified in the flowchart and/or block diagram block or blocks.

The computer-usable or computer-readable medium may be, for example but not limited to, an electronic, magnetic, optical, electromagnetic, infrared, or semiconductor system, apparatus, or device. More specific examples (a nonexhaustive list) of the computer-readable medium would include the following: an electrical connection having one or more wires, a portable computer diskette, a random access memory (RAM), a read-only memory (ROM), an erasable programmable read-only memory (EPROM or Flash memory), an optical fiber, and a compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart and/or block diagram block or blocks.

Computer program code for carrying out operations of systems, methods, and computer program products according to some embodiments of the present invention discussed below may be written in a high level programming language, such as C or C++, for development convenience. In addition, computer program code for carrying out operations of embodiments of the present invention may also be written in other programming languages, such as, but not limited to, interpreted languages. Some modules or routines may be written in assembly language or even micro-code to enhance performance and/or memory usage. It will be further appreciated that the functionality of any or all of the program modules may also be implemented using discrete hardware components, one or more application specific integrated circuits (ASICs), or a programmed digital signal processor or microcontroller.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the present application and the relevant art, and will not be interpreted in an idealized or overly formal sense unless expressly so defined herein.

As used herein, "Positioning System" or "PS" refers to land-based (terrestrial) positioning systems, space-based (celestial or extra-terrestrial) positioning systems, and combinations thereof. According to some embodiments, the Positioning System is a global positioning system (as discussed in more detail below). According to some embodiments, the Positioning System is a terrestrial positioning system.

As used herein, "global positioning system" and "GPS" refer to any of the global positioning systems which are space-based (celestial) systems employing satellites and computers to measure positions anywhere on the earth. Such global positioning systems may include the global positioning system originally constructed for use by the United States military and subsequently and currently made available for civilian use. Such global positioning systems may include the GLONASS satellite navigation system in Europe. In a global positioning system, a plurality of GPS satellites orbit the earth and emit specially coded radio signals that are received by GPS receivers. A GPS receiver may include a processor configured to process at least certain of these signals (the accuracy of a GPS receiver may be limited by its type (i.e., civilian or military) or sophistication). The GPS receiver receives the radio signals from selected satellites (typically, the closest satellites) and measures the time that the radio signals take to travel from the GPS satellites to the GPS receiver antenna. By multiplying the travel time by the speed of light, the GPS receiver can calculate a range for each of the selected satellites. From additional information provided in the radio signals from the satellites, including each satellite's orbit and velocity, the GPS receiver can calculate the position of the GPS receiver through a process of triangulation. The GPS receiver may also be enabled to compute position, velocity and time.

A "terrestrial positioning system" or "TPS" as used herein may include any suitable land-based system enabling electronic distance measurement. Typically, such systems use time difference and trilateration positioning technique in a manner similar to that discussed above in relation to GPS. However, in the case of TPS's, the signals (e.g., radio signals) are emitted from land-based sources such as cellular base stations or beacon stations. A TPS may itself receive and utilize signals from a GPS.

As used herein, "automatically" means without user intervention.

According to some embodiments of the present invention and with reference to FIG. 1, a method for providing an alert or warning from an emergency vehicle (or emergency response vehicle) to an occupant of a second vehicle is provided. According to the method, an alert signal is received at a receiver device carried on the second vehicle (Block 50). Responsive to the received alert signal, the occupant of the second vehicle is automatically warned that the emergency vehicle may be approaching and/or is in a vicinity or proximity of the second vehicle (Block 52).

According to some embodiments of the present invention, a method for providing an alert from an emergency vehicle to an occupant of a second vehicle includes emitting an alert signal to a receiver device on the second vehicle. The receiver device is responsive to the received alert signal to automatically warn the occupant of the second vehicle that the emergency vehicle may be approaching and/or is in a vicinity of the second vehicle.

Figure 2:
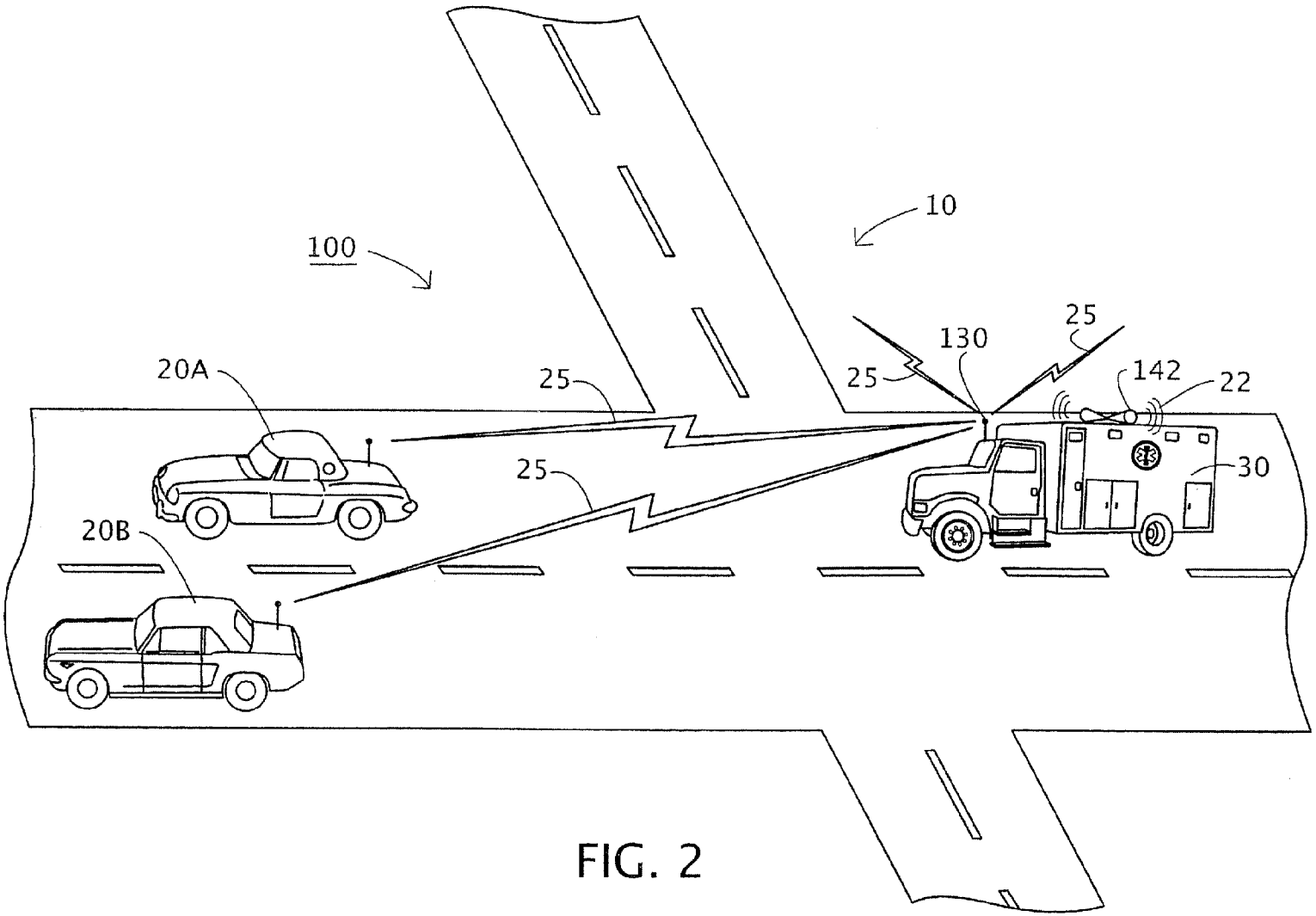
FIG. 2 is a schematic diagram illustrating an emergency vehicle and a pair of second vehicles on a roadway and an alert communication system according to embodiments of the present invention.

With reference to FIG. 2, an alert communication system 100 according to embodiments of the present invention and which may be used to execute methods as described above is shown therein in use on a roadway 10. More particularly and as described in more detail below, the system 100 is employed to warn occupants (e.g., drivers) of vehicles 20A, 20B that an emergency vehicle 30 (or emergency response vehicle) may be approaching and/or in the vicinity of the vehicles 20A, 20B. As will be appreciated, such warning may enable the occupants of the vehicles 20A, 20B to take appropriate action or evasive maneuvers such as stopping or moving to the side of the road or the like.

In an exemplary usage, the emergency vehicle 30 operator may wish to alert drivers in the emergency vehicle's path or vicinity that the emergency vehicle 30 is in emergency or expedited travel mode. The emergency vehicle operator may activate an audible alert device such as a siren to play or broadcast a relatively loud warning signal or sound 22. The siren may effectively warn some drivers; however, some drivers may be ensconced in highly sound attenuating vehicles and/or may be listening to loud music or the like so that they do not detect the siren sound or they detect the siren sound only as the emergency vehicle is in relatively close proximity to their vehicle. As such, the drivers' capacity to accommodate the emergency vehicle may be greatly diminished and/or the drivers may be startled.

In accordance with some embodiments of the present invention, the emergency vehicle 30 may emit alert signals 25 to the vehicles 20A, 20B. According to some embodiments, the signals 25 are broadcast. The signals 25 are generated and transmitted by an emergency vehicle warning system or sender device 120 (which is carried on the emergency vehicle 30) to the vehicles 20A, 20B, where the signals 25 are received by respective in-vehicle or vehicle mounted audio and/or visual alert systems or receiver devices 150 (which are carried on the vehicles 20A, 20B). The systems 150 are adapted to detect and automatically respond to and process the signal 25. The system 150 in each vehicle 20A, 20B responds to the received signal 25 by automatically (i.e., without requiring intervention by the occupant) warning the occupant that the emergency vehicle 30 is in the vicinity of the vehicle 20A, 20B. As discussed herein, the system 150 may provide additional information to the occupant, as well.

The alert signals 25 are wireless signals. According to some embodiments, the alert signals 25 are radiofrequency (RF) signals. Any suitable RF frequency or frequencies may be employed. According to some embodiments, the RF frequency of the signal is in a range reserved for such emergency vehicle alert communications. According to some embodiments, the alert signals 25 have an effective transmission range of at least about 700 yards and, according to some embodiments, at least 1500 yards. According to some embodiments, the alert signals 25 have an effective transmission range of between about 700 and 2000 yards and, according to some embodiments, between about 1500 and 2000 yards.

Figure 3:
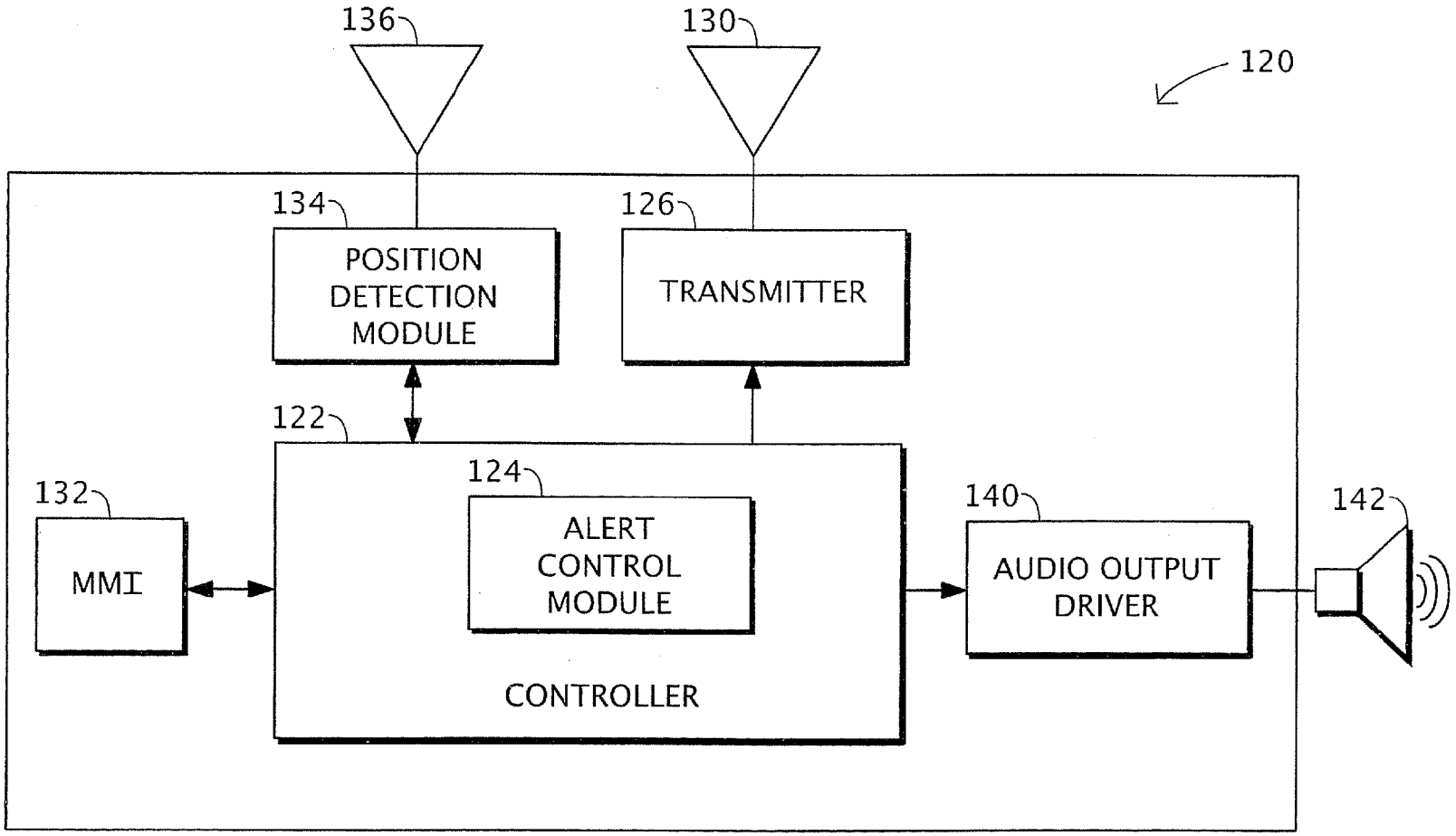
FIG. 3 is a block diagram representing an emergency vehicle warning system forming a part of the alert communication system of FIG. 2 according to embodiments of the present invention.

With reference to FIG. 3, an emergency vehicle warning system 120 according to some embodiments of the present invention is shown therein. The system 120 includes a controller 122 and a transmitter 126, a Man Machine Interface (MMI) 132, a position detection module 134 and an audio output driver 140 operatively coupled to the controller 122 for communication therewith. The controller 122 includes or is coupled with an alert control module 124. The transmitter 126 is coupled to an antenna 130. The position detection module 134 is coupled to an antenna 136. The audio output driver 140 is coupled to a speaker 142.

The controller 122 may be any suitable device configured to coordinate and manage the operations of the other components of the system 150 and to execute the steps described herein.

The position detection module 134 may be any suitable device operative or operable to ascertain the geographic location of the system 120 and, thus, the geographic location of the emergency vehicle 30. According to some embodiments, the position detection module 134 includes a GPS receiver. According to some embodiments, the position detection module 134 includes a TPS receiver.

The MMI 132 may include any suitable components for interfacing with an operator. For example, the MMI 132 may include a keypad, one or more control buttons or switches, a display screen, and/or indicator lamps or the like.

The audio output driver 140 may be any suitable device for converting audio signals from the controller 122 to sound (e.g., a siren sound) via the speaker 142.

Figure 4:
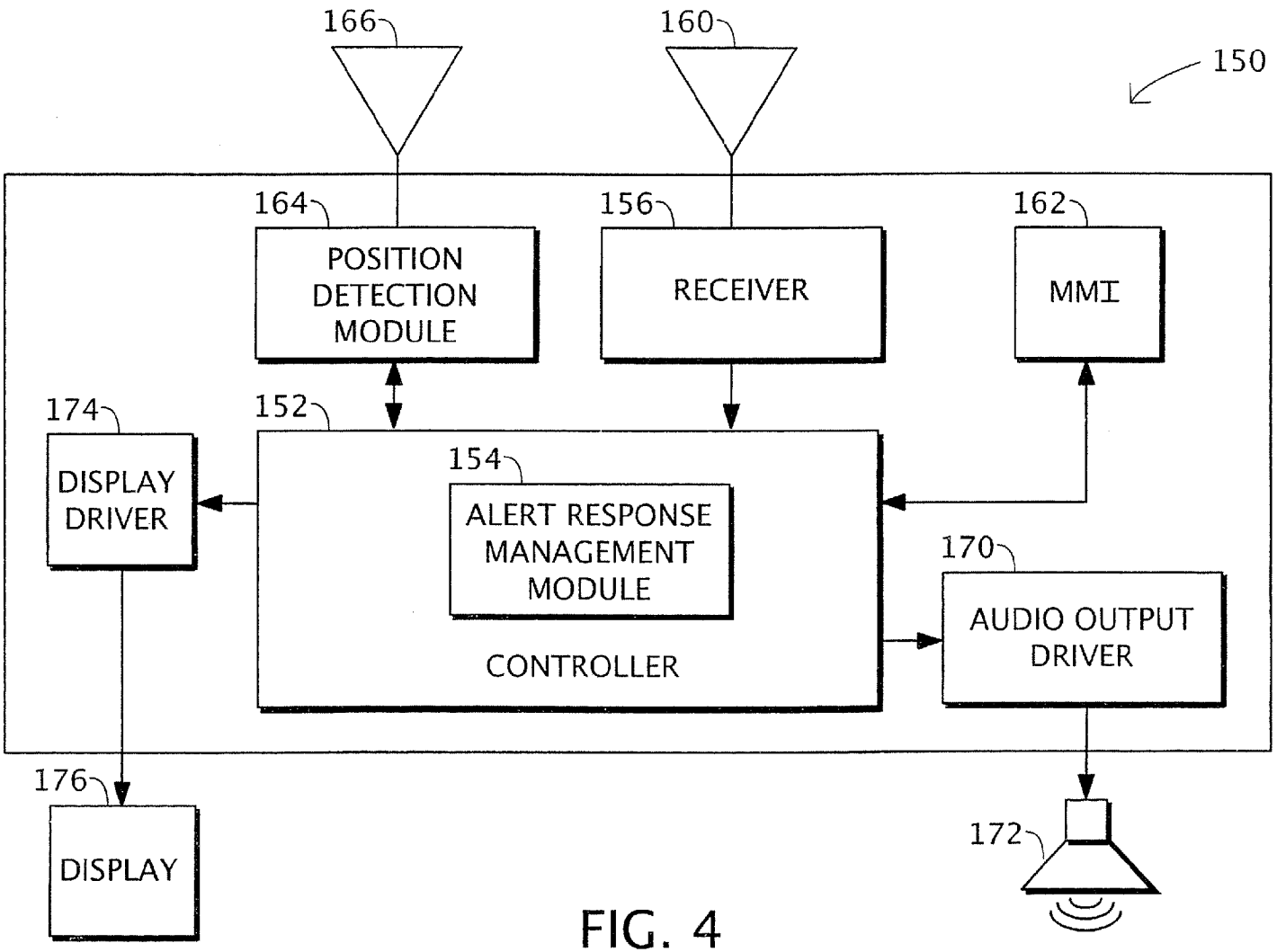
FIG. 4 is a block diagram representing an in-vehicle audio and/or visual alert system forming a part of the alert communication system of FIG. 2 according to embodiments of the present invention.

With reference to FIG. 4, an in-vehicle system 150 according to some embodiments of the present invention is shown therein. The system 150 includes a controller 152 and a receiver 156, an MMI 162, a position detection module 164, an audio output driver 170, and a display driver 174 coupled to the controller 152 for communication therewith. The controller 152 includes or is coupled with an alert response management module 154. The receiver 156 is coupled with an antenna 160. The position detection module is coupled with an antenna 166. The audio output driver 170 is coupled with a speaker 172. The display driver 174 is coupled with a display 176.

The controller 152 may be any suitable device configured to coordinate and manage the operations of the other components of the system 150 and to execute the operations described herein.

The position detection module 164 may be any suitable device operable to ascertain the geographic location of the system 150 and, thus, the geographic location of the associated vehicle 20A, 20B. According to some embodiments, the position detection module 164 includes a GPS receiver. According to some embodiments, the position detection module 164 includes a TPS receiver.

The MMI 162 may include any suitable components for interfacing with an operator. For example, the MMI 162 may include a keypad, one or more control buttons or switches, and/or indicators or the like.

The audio output driver 170 may be any suitable device for converting audio signals from the controller 152 to sound via the speaker 172.

The display driver 174 may be any suitable device for converting display signals from the controller 152 to graphic or other visual images via the display 176.

In general, the aforedescribed components of the system 150 other than the alert response management module 154 may constitute conventional or otherwise provided components of an in-vehicle entertainment and/or informational system. For example, the system 150 may include a GPS (or otherwise) enabled navigation system and an in-vehicle radio receiver unit. The various components may be provided as an integrated unit or may be distributed. According to some embodiments, the alert response management module 154 is preinstalled (i.e., built-in) or integrated within the system 150. According to other embodiments, the alert response management module 154 is an auxiliary module that is added onto an entertainment and informational system of a vehicle in any suitable manner. For example, the alert response management module 154 may be a plug-in module and/or may wirelessly communicate with the controller 152.

Various implementations of the system 100 in accordance with embodiments of the present invention will now be described with reference to an exemplary use of the emergency vehicle 30. The operator of the emergency vehicle 30 wishes to alert drivers in the path or vicinity of the emergency vehicle 30, for example, to clear traffic for more expeditious travel to or from an emergency site. The operator activates (e.g., using the MMI 132) the system 120 to emit the alert signal 25. More particularly, the controller 122 causes the transmitter 126 to emit the alert signal 25 via the antenna 130. The operator may also activate the system 120 to emit the siren sound 22 via the speaker 142. According to some embodiments, activation of the siren automatically activates the alert signal 25.

When in the range of the alert signal 25, the systems 150 in the vehicles 20A, 20B detect the alert signal 25 and take appropriate automatic action or response. The response may vary in accordance with different embodiments. For the purposes of discussion, the following description will reference only the vehicle 20A; however, it will be appreciated that this description may likewise apply to the vehicle 20B.

According to some embodiments, in response to the alert signal 25, the alert response management module 154 causes the system 150 to automatically play an audible message or warning via the speaker 172. According to some embodiments, the audible message is a voice message. According to some embodiments, the audible message informs the occupant of the vehicle 20A that an emergency vehicle is approaching. According to some embodiments, the module 154 also automatically mutes or reduces the volume of the vehicle's radio (or other audio media playback device) to better enable the occupant to hear the message and/or the siren. According to some embodiments, the module 154 mutes the vehicle radio, etc., but does not play a message.

According to some embodiments, the audible message is a prescribed message from an audio media file preexisting in the memory of the system 150 (i.e., a "canned" or prerecorded message). According to some embodiments, the audio message is embodied in the alert signal 25.

The audio message may include supplemental or customized information. According to some embodiments, the audio message includes an identification of the type of emergency vehicle (e.g., an ambulance, policeman, fire truck, etc.) that is approaching or is in the vicinity. For example, the emergency vehicle 30 may emit an alert signal 25 indicative of its type, and the module 154 may playback a corresponding prerecorded message stating the type of emergency vehicle.

The foregoing messages and information may additionally or alternatively be automatically provided by the module 154 as visual messages or warnings. The visual messages or warnings may be displayed on the display 176.

According to some embodiments, the alert communications system 100 utilizes the position detection module 134 to provide additional information to the occupants of the vehicles 20A, 20B. More particularly, the controller 122 may determine the geographic location and/or other related characteristics of the emergency vehicle 30. Such related characteristics may include speed of travel, direction of travel, velocity of travel, change in location, and/or projected path. The alert control module 124 configures the signal 25 such that the desired geographic or related information is embodied in or incorporated into the alert signal 25.

According to some embodiments, the alert signal 25 includes a message (for playback by the system 150) independent of the vehicle 20A. For example, the message may be "Warning, an ambulance is headed south on Broad Street between First Avenue and Second Avenue".

According to some embodiments, the positional or movement data acquired by the position detection module 134 is used in combination with a determination by the position detection module 164 of the geographic location of the vehicle 20A and/or related characteristics. For example, the module 154 may determine the location, change in location, and/or direction of travel of the emergency vehicle 30 from the signal 25 (which includes the positional data from the position detection module 134) and may also determine the position and/or direction of travel of the associated vehicle 20A from the position detection module 164. The system 150 may then automatically configure or select and play or display a corresponding warning message such as "Warning, an ambulance is approaching from your left."

Using the information embodied in the alert signal 25 and/or other data (e.g., from the position detection module), the controller 152 may identify or configure a warning message including further intelligent instructions or information. According to some embodiments, the controller 152 uses such information to deduce or construct a message customized for the vehicle 20A. For example, the alert signal 25 may provide the controller 152 with the vehicle ID, vehicle type, latitude, longitude, altitude, direction of travel, and/or speed of travel of the emergency vehicle 30. The controller may use this information to determine whether the driver of the vehicle 20A should be warned to move over (or take other appropriate action) or told that the emergency vehicle 30 is not of concern with regard to the vehicle 20A. For example, if the controller 152 determines from the alert signal 25 that the emergency vehicle 30 is a fire truck approaching the vehicle 20A from the rear at 60 mph, the controller 152 may warn the driver of the vehicle 20A with a message such as "A fire truck is approaching from the rear. You have thirty seconds to yield right of way." By way of further example, if the controller 152 determines that an ambulance is in the opposite lane of a divided highway, the controller 152 may warn the driver of the vehicle 20A with a message such as "An ambulance is approaching in the other lane. You are free to proceed."

Figure 5:
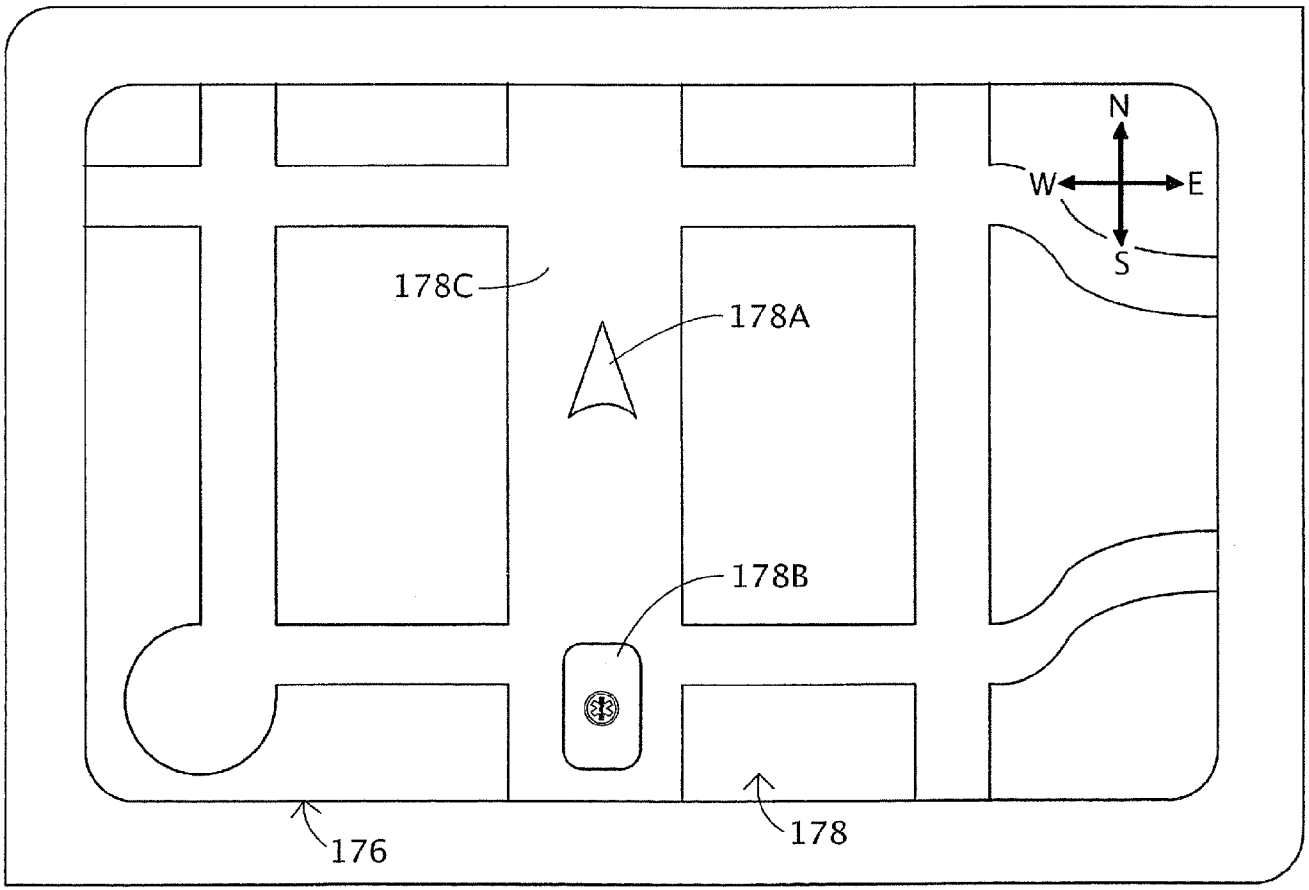
FIG. 5 is a schematic view of a display and an illustrative display image of the in-vehicle audio and/or visual alert system of FIG. 4.

According to some embodiments, the system 150 will graphically depict the location and/or path of the emergency vehicle 30 on the display 176 of the system 150. For example, with reference to FIG. 5, a graphic image 178 is displayed on the display 176, wherein the emergency vehicle 30 is symbolically depicted by a graphic element 178B, the vehicle 20A carrying the system 150 is symbolically depicted by the graphic element 178A, and the roadway 10 is depicted by the elements 178C. The graphic depictions of the emergency vehicle 30, the vehicle 20A and/or the roadway 10 may be continuously or periodically updated so that the relative movements of the emergency vehicle 30 and the vehicle 20A are dynamically indicated on the display 176.

While embodiments of the invention have been described herein with various combinations of features or steps, other configurations and methods may be provided in accordance with embodiments of the present invention. For example, one or both of the position detection modules 134, 164 may be omitted or unused in the communication system. Audible alert messages may be provided along with visual alert messages. Audible alert messages may be provided without visual alert messages, and vice-versa.

In the drawings and specification, there have been disclosed exemplary embodiments of the invention, and although specific terms are used, they are used in a generic and descriptive sense only and not for purposes of limitation, the scope of the invention being defined by the following claims.

That which is claimed:

1. A method for providing an emergency vehicle alert to an occupant of a second vehicle, the method comprising:

receiving an alert signal at a receiver device on the second vehicle from the emergency vehicle; and responsive to the received alert signal, determining whether the emergency vehicle is an emergency vehicle of concern or, alternatively, an emergency vehicle of non-concern, and thereafter:

if the emergency vehicle is of concern, automatically warning the occupant of the second vehicle that the emergency vehicle may be approaching and/or is in a vicinity of the second vehicle and that the emergency vehicle is of concern; and if the emergency vehicle is of non-concern, automatically alerting the occupant of the second vehicle that the emergency vehicle is not of concern.

2. The method of claim 1 wherein the alert signal is a radiofrequency (RF) signal.

3. The method of claim 1 wherein warning the occupant includes playing an audible alert to the occupant.

4. The method of claim 3 wherein the audible alert includes a voice message including a description of the emergency vehicle.

5. The method of claim 4 wherein the voice message is a prerecorded voice message.

6. The method of claim 3 wherein the audible alert includes a voice message including a description of a location and/or direction of travel of the emergency vehicle relative to the second vehicle.

7. The method of claim 3 including, responsive to the received alert signal, automatically muting and/or reducing a volume of an audio device of the second vehicle to enable the occupant to better hear the audible alert.

8. The method of claim 3 wherein the audible alert includes a voice message independent of the second vehicle.

9. The method of claim 1 wherein warning the occupant includes displaying a visual alert to the occupant.

10. The method of claim 9 wherein the visual alert includes a displayed image indicating a location and/or change in location of the emergency vehicle relative to the second vehicle.

11. The method of claim 10 including determining a location of the second vehicle using a Positioning System receiver.

12. The method of claim 1 further including:

emitting the alert signal from the emergency vehicle to the receiver device on the second vehicle.

13. The method of claim 12 wherein emitting the alert signal includes broadcasting the alert signal.

14. The method of claim 1, wherein alerting the occupant includes playing a voice message including a statement that the emergency vehicle is not of concern.

15. The method of claim 1 wherein the alert signal is a radiofrequency (RF) signal and the method further includes:

broadcasting the alert signal from the emergency vehicle to the receiver device on the second vehicle;

responsive to the received alert signal, determining a location of the second vehicle using a Positioning System receiver;

if the emergency vehicle is of concern:

playing a prerecorded voice message to the occupant of the second vehicle including:

a warning that the emergency vehicle may be approaching and/or is in a vicinity of the second vehicle;

either a description of the emergency vehicle or a description of the location and/or direction of travel of the emergency vehicle relative to the second vehicle; and a statement that the emergency vehicle is of concern; and displaying a visual alert to the occupant of the second vehicle including:

a displayed image indicating the location and/or change in location of the emergency vehicle relative to the second vehicle; and if the emergency vehicle is of non-concern:

playing a prerecorded voice message to the occupant of the second vehicle including a statement that the emergency vehicle is not of concern.

16. An alert system for providing an emergency vehicle alert to an occupant of a second vehicle, the system comprising:

a receiver device on the second vehicle configured to:

receive an alert signal from the emergency vehicle; and responsive to the received alert signal, determine whether the emergency vehicle is an emergency vehicle of concern or, alternatively, an emergency vehicle of non-concern, and thereafter:

if the emergency vehicle is of concern, automatically warn the occupant of the second vehicle that the emergency vehicle may be approaching and/or is in a vicinity of the second vehicle and that the emergency vehicle is of concern; and if the emergency vehicle is of non-concern, automatically alert the occupant of the second vehicle that the emergency vehicle is not of concern.

17. The system of claim 16 including a sender device on the emergency vehicle, wherein the sender device is configured to emit the alert signal to the receiver device.

18. The system of claim 16 wherein the receiver device is configured to automatically play an audible alert to the occupant responsive to the received alert signal.

19. The system of claim 16 wherein the receiver device is configured to automatically display a visual alert to the occupant responsive to the received alert signal.

20. A computer program product for providing an emergency vehicle alert to an occupant of a second vehicle, the computer program product comprising:

a computer readable storage medium including computer readable program code embodied therein, the computer readable program code comprising:

computer readable program code configured to receive an alert signal at a receiver device on the second vehicle from the emergency vehicle; and computer readable program code configured to:

responsive to the received alert signal, determine whether the emergency vehicle is an emergency vehicle of concern or, alternatively, an emergency vehicle of non-concern, and thereafter:

if the emergency vehicle is of concern, automatically warn the occupant of the second vehicle that the emergency vehicle may be approaching and/or is in a vicinity of the second vehicle and that the emergency vehicle is of concern; and if the emergency vehicle is of non-concern, automatically alert the occupant of the second vehicle that the emergency vehicle is not of concern.

* * * * *